US008276536B2

(12) United States Patent
Winsky et al.

(10) Patent No.: US 8,276,536 B2
(45) Date of Patent: Oct. 2, 2012

(54) RUDDER SYSTEM

(76) Inventors: James Winsky, Ottawa, KS (US); Merle W. Winsky, Ottawa, KS (US)

( * ) Notice: Subject to any disclaimer, the term of this patent is extended or adjusted under 35 U.S.C. 154(b) by 1243 days.

(21) Appl. No.: 12/025,118

(22) Filed: Feb. 4, 2008

(65) Prior Publication Data

US 2009/0198395 A1 Aug. 6, 2009

(51) Int. Cl.

| | |
|---|---|
| ***B63B 35/71*** | (2006.01) |
| ***B63H 25/42*** | (2006.01) |
| ***B63H 25/06*** | (2006.01) |
| ***B63H 25/00*** | (2006.01) |

(52) U.S. Cl. ..... 114/347; 440/51; 114/162; 114/153

(58) Field of Classification Search ..... 114/162, 114/144 A, 347; 440/6, 7, 21, 51, 53, 25
See application file for complete search history.

(56) References Cited

U.S. PATENT DOCUMENTS

| | | | | |
|---|---|---|---|---|
| 1,840,949 | A * | 1/1932 | Harvey | 440/65 |
| 2,079,871 | A * | 5/1937 | Price | 440/6 |
| 3,575,124 | A | 4/1971 | Alter | |
| 3,601,344 | A | 8/1971 | Nourse | |
| 4,226,206 | A * | 10/1980 | Wilson | 440/112 |
| 4,231,309 | A | 11/1980 | Pelletier | |
| 4,286,536 | A | 9/1981 | Alter | |
| 4,944,702 | A * | 7/1990 | Cain | 440/51 |
| 6,478,639 | B1 * | 11/2002 | Covell, III | 440/6 |
| 6,612,252 | B2 * | 9/2003 | King et al. | 114/153 |
| 6,739,276 | B1 * | 5/2004 | Rard | 114/347 |
| 6,884,128 | B2 * | 4/2005 | Okuyama et al. | 440/1 |
| 2002/0195039 | A1 | 12/2002 | Anderson | |

* cited by examiner

*Primary Examiner* — Lars A Olson
*Assistant Examiner* — Andrew Polay
(74) *Attorney, Agent, or Firm* — Dale J. Ream

(57) ABSTRACT

A rudder system for a kayak includes a rudder configured for pivotal attachment to the kayak and a propeller housed in and extending from the rudder. A battery is in electrical communication with the propeller to selectively power the propeller. The kayak system includes an input in electrical communication with the propeller to operatively actuate the propeller, the input being accessible from inside the kayak. A sensor is operatively coupled to the kayak to determine a relative speed thereof. A processor is in data communication with the sensor and propeller, the processor including programming to determine a necessary propeller speed. The processor is in data communication with the input so as to establish the desired relative speed of the kayak. The propeller includes at least two blades and the propeller motor is housed in the rudder.

5 Claims, 10 Drawing Sheets

RUDDER SYSTEM

BACKGROUND OF THE INVENTION

This invention relates to boat rudder systems and, more particularly, to a rudder system for a kayak that enables the kayak to be propelled, steered, and speed controlled without the use of a paddle or a user's hands.

A kayak is a relatively small personal watercraft that is popular for both recreational boaters and for fisherman. Such watercraft are relatively lightweight, easy to load and transport, and easy to control in stable water conditions. However, a kayak becomes difficult to maneuver, guide, or propel when a user desires to operate a fishing rod or otherwise does not desire to use his hands for operating a paddle.

Various devices have been proposed for propelling watercraft, such as electric motor powered propellers. Other devices have been proposed for guiding or steering kayaks, such as rudders with foot pedals. Although these devices are assumably effective for their intended purposes, no devices or proposals have ever been made for a rudder system that enables a kayak to be both propelled and steered without the use of a paddle controlled by a user's hands.

Therefore, it would be desirable to have a rudder system for a kayak that enables a kayak to be selectively propelled without the use of a paddle. Further, it would be desirable to have a rudder system that enables a kayak to be steered without the use of a paddle. Finally, it would be desirable to have a rudder system that is easy to mount to a kayak, easily connectable to a battery, and easy to operate.

SUMMARY OF THE INVENTION

A rudder system for a kayak according to the present invention includes a rudder configured for pivotal attachment to the kayak and a propeller housed in and extending from the rudder. A battery is in electrical communication with the propeller to selectively power the propeller. The kayak system includes an input in electrical communication with the propeller to operatively actuate the propeller, the input being accessible from inside the kayak. A sensor is operatively coupled to the kayak to determine a relative speed thereof. A processor is in data communication with the sensor and propeller, the processor including programming to determine a necessary propeller speed. The processor is in data communication with the input so as to establish the desired relative speed of the kayak. The propeller includes at least two blades and the propeller motor is housed in the rudder.

Therefore, a general object of this invention is to provide a rudder system for use with a kayak that enables the kayak to be propelled and steered without use of a paddle or a user's hands.

Another object of this invention is to provide a rudder system, as aforesaid, that includes a speed control so that the kayak may be propelled at a desired speed.

Still another object of this invention is to provide a rudder system, as aforesaid, that is easy to mount to a kayak and user-friendly to use.

Yet another object of this invention is to provide a rudder system, as aforesaid, that is economical to manufacture.

Other objects and advantages of the present invention will become apparent from the following description taken in connection with the accompanying drawings, wherein is set forth by way of illustration and example, embodiments of this invention.

DESCRIPTION OF THE PREFERRED EMBODIMENT

A rudder system for a kayak according to the present invention will now be described in detail with reference to FIG. 1 through FIG. 10 of the accompanying drawings. More particularly, the rudder system 100 includes a rudder 110 and a propeller 120 coupled to the rudder 110.

Figure 8:
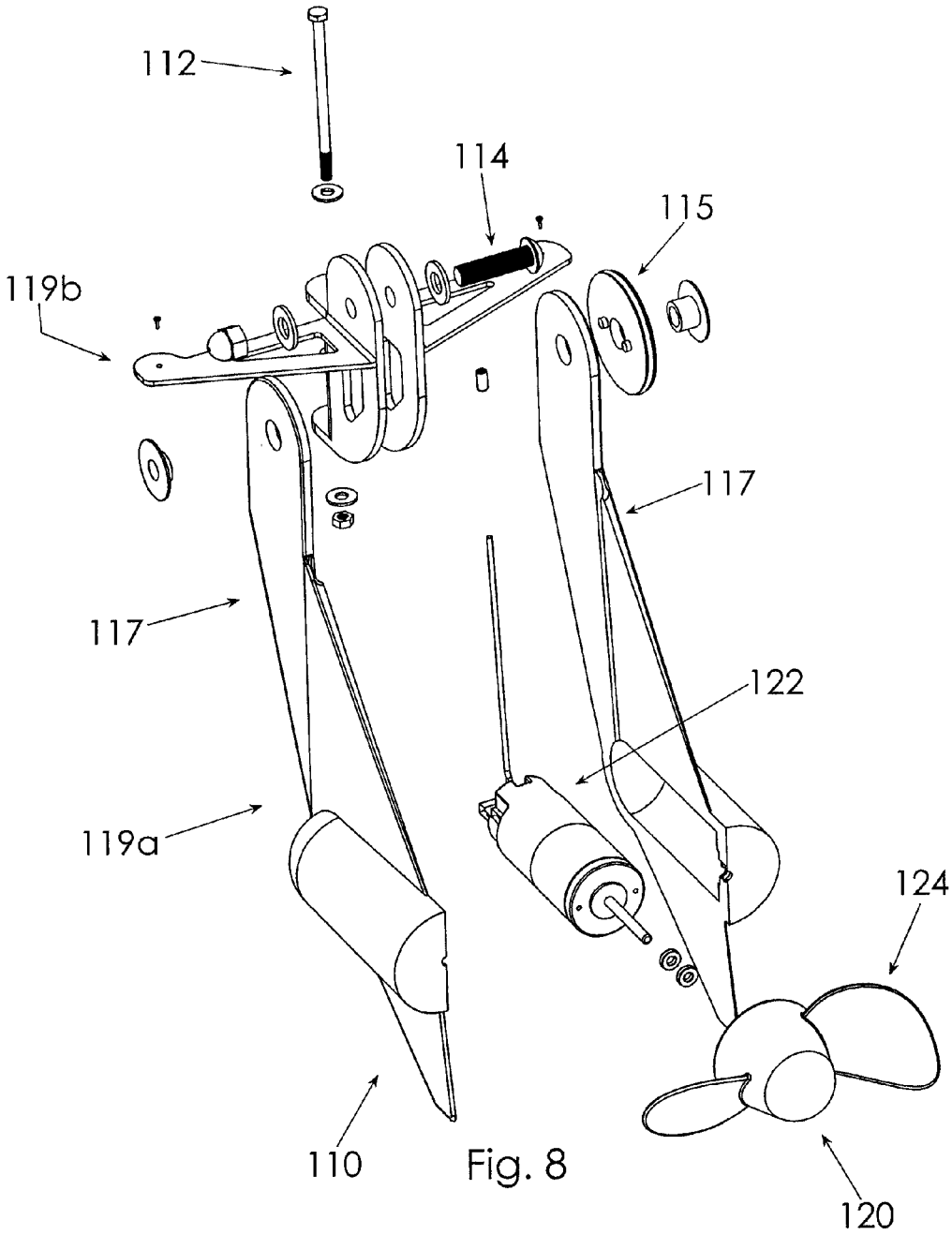
FIG. 8 is an exploded view of the propeller as in FIG. 2.

The rudder 110 is configured for pivotable attachment to a kayak 10, such as by pivot bolt 112 as shown in FIG. 8. It may be desirable for the rudder 110 to be configured to be interchangeable with existing kayak rudders, or in other words, to be operable with existing kayak hardware used for attaching rudders. It should be understood that the rudder 110 may pivotally attach directly to the kayak 10, or that one portion of the rudder may attach to the kayak 10 in a non-pivotal manner and that another portion of the rudder may pivot relative to the kayak 10. The rudder 110 may be configured for upward retraction so that the rudder 110 may be retracted when not in use or when in very shallow water. For example, the rudder 110 may be pivoted upwardly about pivot bolt 114, as shown in FIG. 8. A pulley 115 (FIG. 8) and rope 116 (FIG. 2) may be used to retract the rudder 110 upwardly about the pivot bolt 114.

As shown in FIG. 8, the propeller 120 may include a motor 122 and at least two blades 124 selectively rotated by the motor 122. The propeller blades 124 extend from the rudder 110, and the propeller motor 122 may be housed in the rudder 110. More particularly, the rudder 110 may include two side portions 117 (FIG. 8) that sandwich the propeller motor 122.

Figure 5:
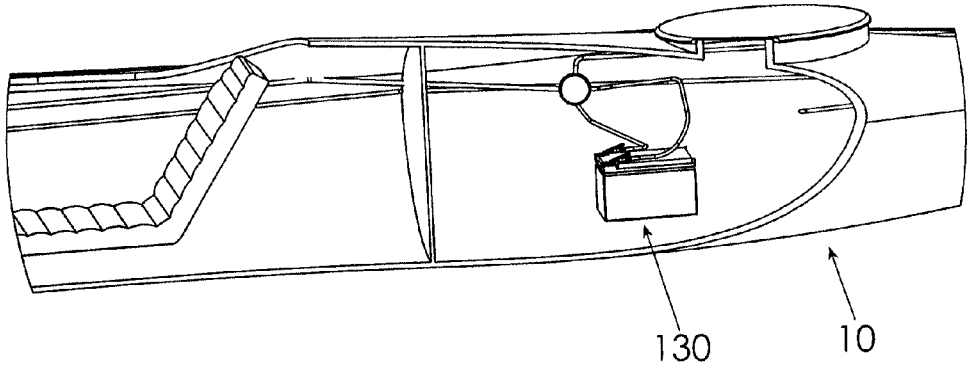
FIG. 5 is an isolated view on an enlarged scale taken from a portion of FIG. 3.

A battery 130 (FIGS. 5 and 10) is in electrical communication with the propeller 120 to selectively power the propeller 120. It may be desirable for the battery 130 to be located outside the rudder 110. For example, as shown in FIG. 5, the battery 130 may be located inside the kayak 10 and wiring 131 may extend through the rudder 110 (FIG. 6) to allow electrical communication between the battery 130 and the propeller motor 122.

Figure 1:
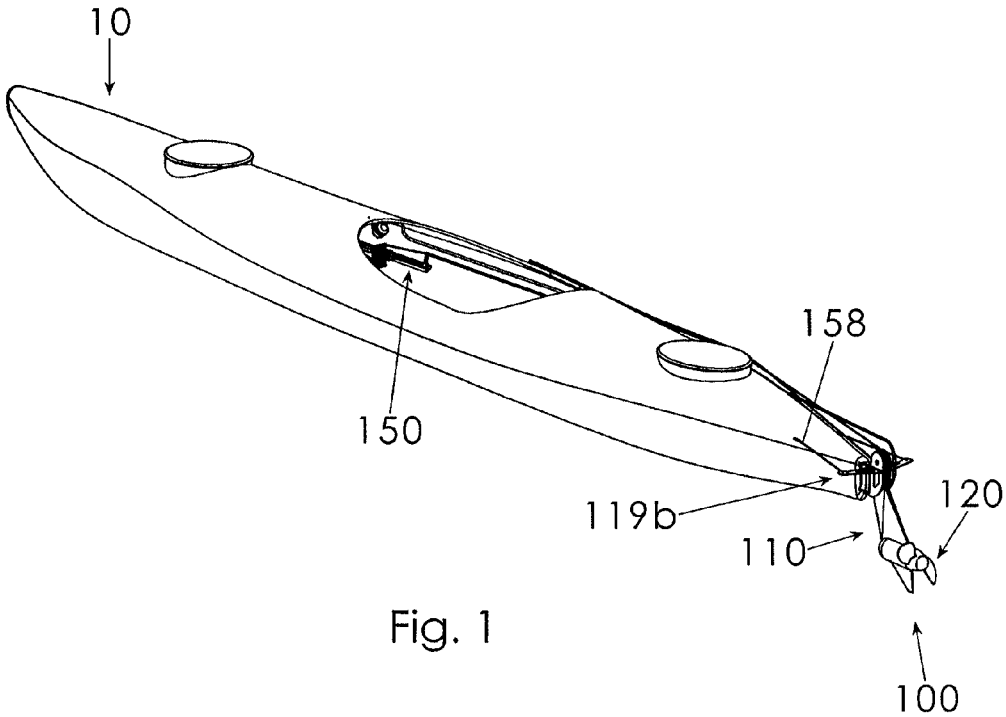
FIG. 1 is a perspective view of a rudder system according to a preferred embodiment of the present invention in use with a kayak.
Figure 2:
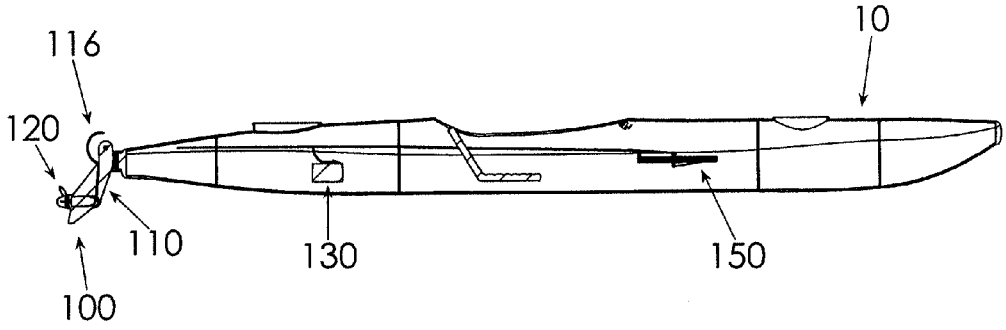
FIG. 2 is a side view of the rudder system as in FIG. 1.
Figure 3:
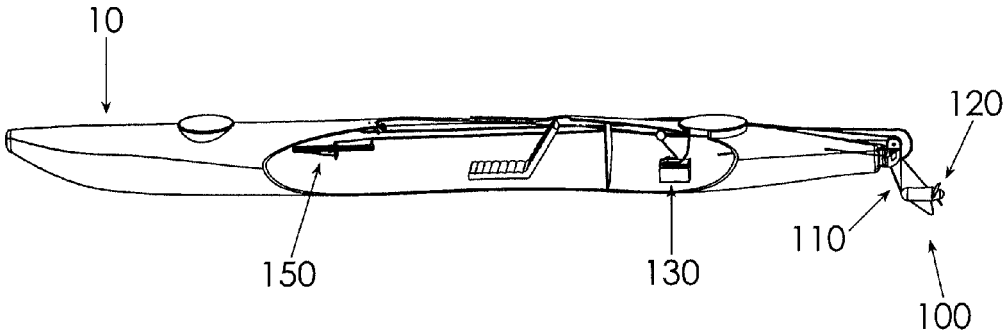
FIG. 3 is a side view of the rudder system as in FIG. 2 taken from a reverse angle and having a portion of the kayak removed for clarity.
Figure 4:
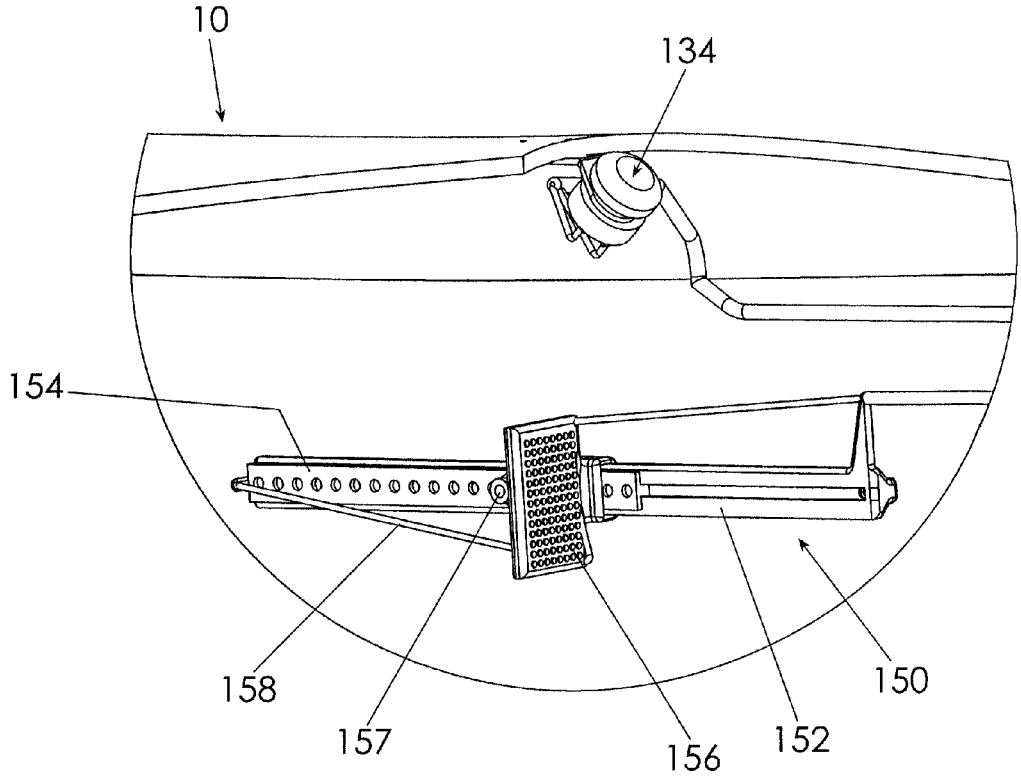
FIG. 4 is an isolated view on an enlarged scale taken from a portion of FIG. 3.

An input 134 (FIGS. 4 and 10) may be in electrical communication with the propeller 120 to operatively actuate the propeller 120. It may be desirable for the input 134 to be accessible from inside the kayak 10, as shown in FIG. 4. The input 134 may include a plurality of setting that correspond to respective desired propeller speeds to operatively actuate the propeller 120 at the respective desired propeller speeds. For example, the input 134 may be used to actuate the propeller 120 at low, medium, and high speeds.

Figure 10:
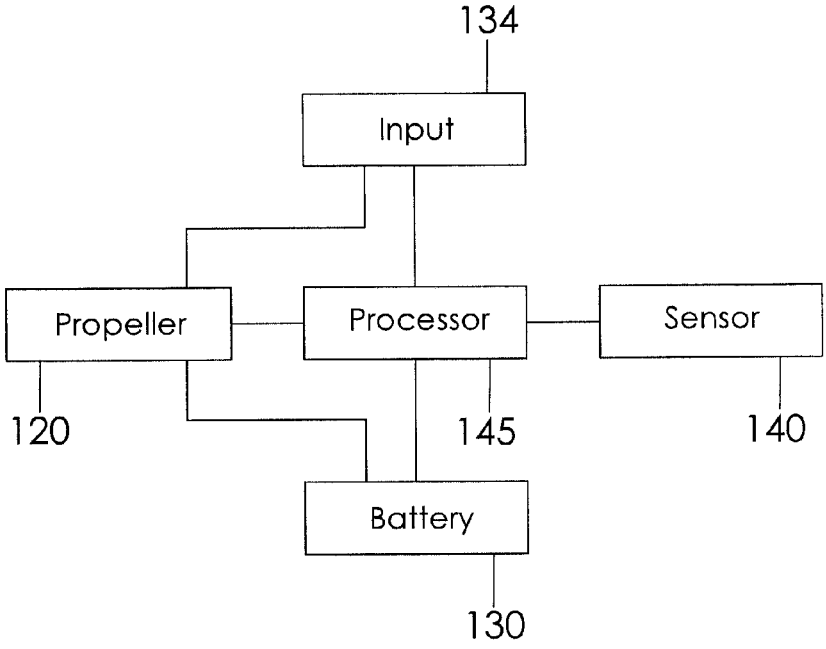
FIG. 10 is a block diagram of the electronic components of the rudder system.

As shown in FIG. 10, a sensor 140 may be operatively coupled to the kayak 10 to determine a relative speed of the kayak 10, and a processor 145 may be in data communication with the sensor 140 and the propeller 120. The input 134 may be in data communication with the processor 145 to establish a desired relative speed of the kayak 10. The processor 145 may include programming to determine a necessary propeller speed to achieve the desired relative speed of the kayak 10 (as provided by the input 134) and programming to actuate the propeller 120 to rotate at the necessary propeller speed.

Figure 9:
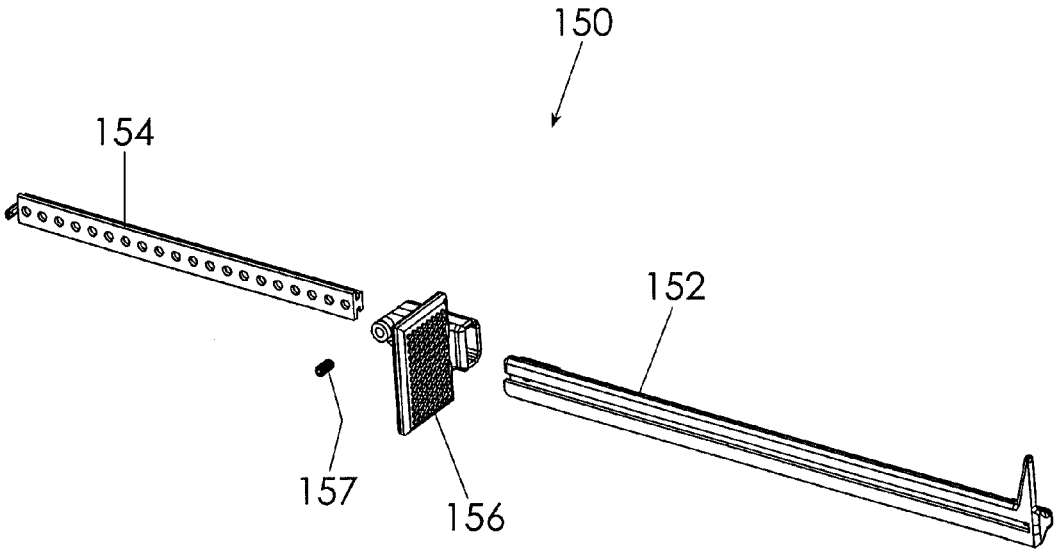
FIG. 9 is an exploded view of the pedal assembly as in FIG. 3.

Means may be included for pivoting the rudder from side to side. For example, traditional pedal assemblies currently on the market may be used. Alternately, first and second pedal assemblies 150 may be included. As shown in FIGS. 4 and 9, each pedal assembly 150 includes a stationary rail 152 configured for attachment to the kayak 10, an adjustable rail 154 slidably coupled to the stationary rail 152, and a pedal 156 fixedly coupled to the adjustable rail 154. Each pedal 156 need not be permanently attached to a respective adjustable rail 154, so long as the pedals 156 do not move relative to the respective adjustable rails 154 when attached thereto. For example, a respective pedal 156 may be movably coupled to a respective adjustable rail 154 by a bolt 157, set screw, pin, etc., as shown in FIG. 9. One linkage 158 may couple the rudder 110 to the pedal 156 and/or the adjustable rail 154 of one pedal assembly 150, and another linkage 158 may couple the rudder 110 to the pedal 156 and/or the adjustable rail 154 of the other pedal assembly 150. As such, movement of one pedal 156 relative to a respective stationary rail 152 may cause the rudder 110 to rotate toward one side, and movement of the other pedal 156 relative to the other stationary rail 152 may cause the rudder 110 to rotate toward the other side.

Figure 6:
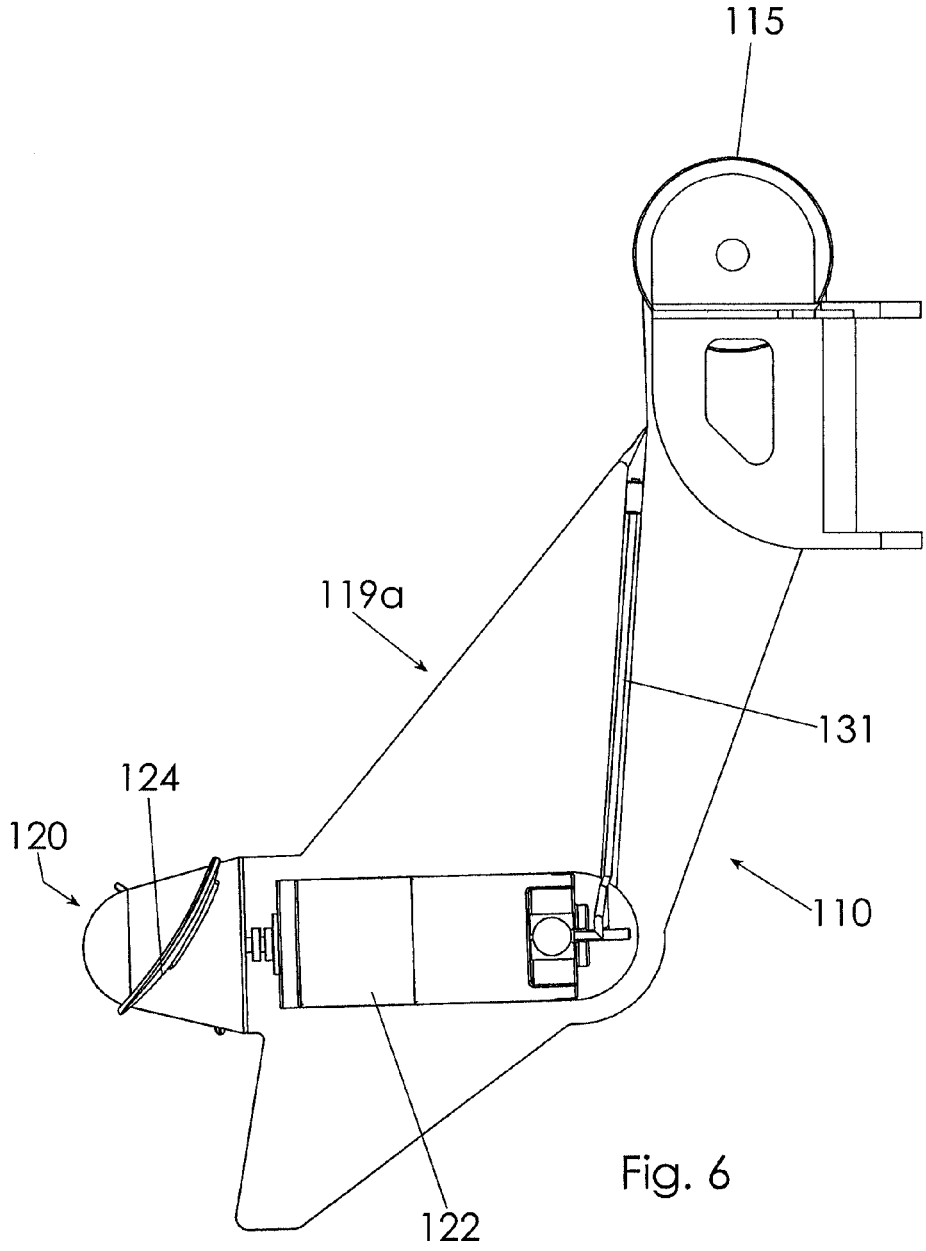
FIG. 6 is side view of the propeller on an enlarged scale as in FIG. 2 with the kayak removed.
Figure 7:
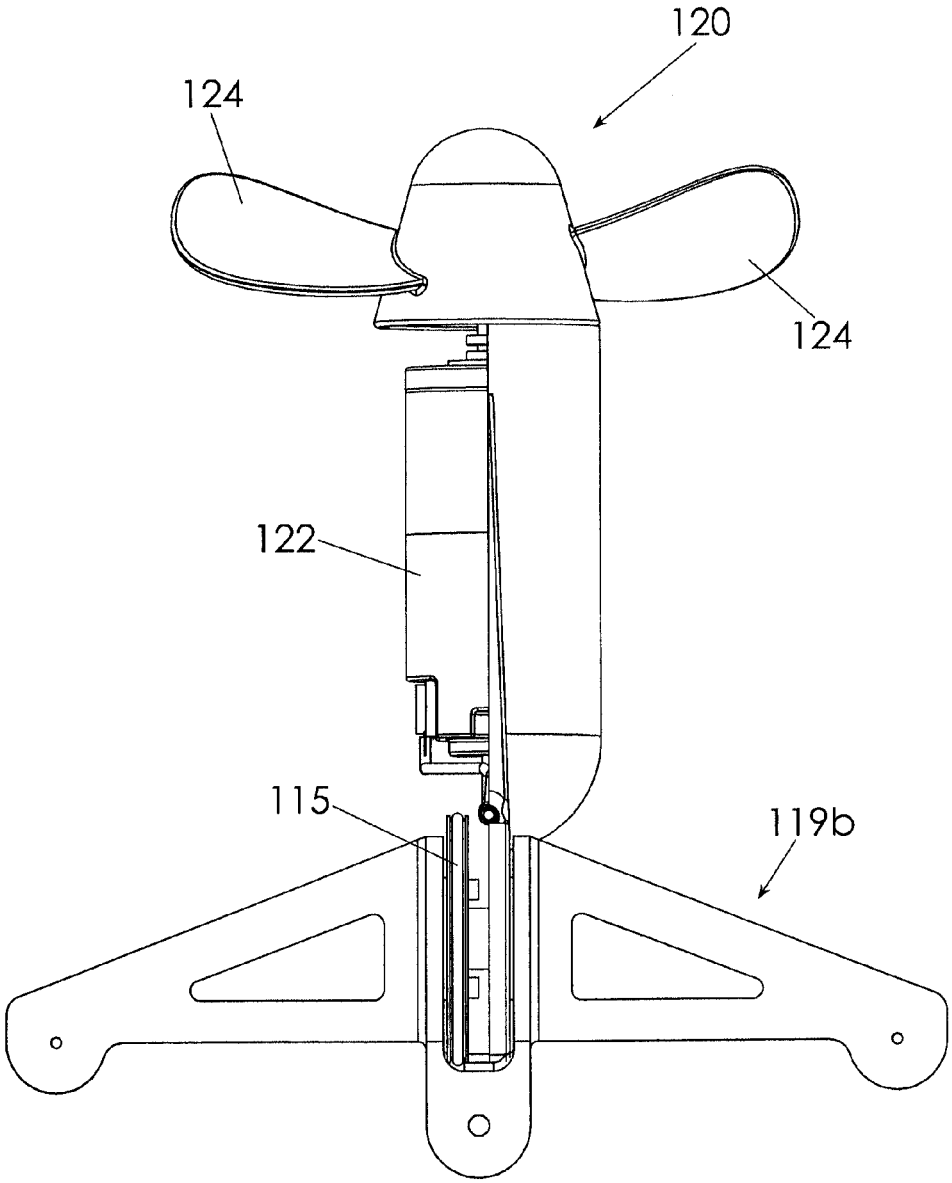
FIG. 7 is a top view of the propeller as in FIG. 6.

As shown in FIGS. 6 through 8, the rudder 110 may include a steering portion 119*a* extending in a generally vertical direction and a linkage attachment portion 119*b* extending bilaterally to (i.e., on both sides of) the steering portion 119*a*. The linkages 158 may be coupled to the linkage attachment portion 119*b*. Each linkage 158 may include, for example, a cable, a chain, and/or a rod.

In use, the user may position each pedal 156 relative to each adjustable rail 154 using the bolts 157 to account for the user's leg length, and pushing the respective pedals 156 may cause the respective linkages 158 to rotate the rudder 110 to the respective sides as set forth above. If the user selects a desired propeller speed using the input 134, the input 134 may operatively actuate the propeller 120 to rotate at the desired propeller speed (e.g., low, medium, high, etc.). If the user selects a desired relative speed using the input 134, the processor 145 may (by using the programming set forth above) utilize data from the sensor 140 to determine a necessary propeller speed to achieve the desired relative speed of the kayak 10 and actuate (by using the programming set forth above) the propeller 120 to rotate at the necessary propeller speed. This may allow the kayak 10 to remain relatively stationary at a chosen location or to move at a substantially constant speed, for example. The processor may constantly, or at chosen intervals, determine necessary propeller speed and actuate the propeller 120 accordingly.

It is understood that while certain forms of this invention have been illustrated and described, it is not limited thereto except insofar as such limitations are included in the following claims and allowable functional equivalents thereof.

The invention claimed is:

1. A rudder system for a kayak, said rudder system comprising:

a rudder configured for pivotable attachment to said kayak;

a propeller coupled to said rudder;

a battery in electrical communication with said propeller to selectively power said propeller;

an input in electrical communication with said propeller and configured to operatively actuate said propeller, said input being accessible from inside said kayak;

first and second pedal assemblies; each said pedal assembly having a stationary rail configured for attachment to said kayak, an adjustable rail slidably coupled to said stationary rail, and a pedal fixedly coupled to said adjustable rail;

a first linkage coupled to said rudder and at least one of said adjustable rail and said pedal of said first pedal assembly;

a second linkage coupled to said rudder and at least one of said adjustable rail and said pedal of said second pedal assembly, whereby movement of one said pedal relative to a respective stationary rail causes said rudder to move to one side and movement of another said pedal relative to a respective stationary rail causes said rudder to move to another side;

said rudder is configured to move about a horizontally situated pivot bolt between an upwardly retracted configuration and a downwardly extended configuration;

a pulley operatively coupled to said kayak and having a rope attached to said rudder that is configured to selectively move said rudder between said upwardly retracted and said downwardly extended configurations;

said first linkage is at least one of a cable, a chain, and a rod; and said second linkage is at least one of a cable, a chain, and a rod;

a sensor operatively coupled to said kayak and configured to determine a relative speed of said kayak;

a processor in data communication with said sensor and said propeller;

wherein said processor is in data communication with said input to establish said desired relative speed of said kayak;

programming in said processor that, when executed, causes said sensor to determine a relative speed of said kayak;

programming in said processor that, when executed, causes said processor to determine a necessary propeller speed to achieve a desired relative speed of said kayak;

programming in said processor that, when executed, causes said processor, to actuate said propeller to rotate at said necessary propeller speed;

programming in said processor that, when executed, determines said necessary propeller speed at predetermined time intervals; and wherein said input includes a plurality of settings corresponding to respective desired propeller speeds to operatively actuate said propeller at said respective desired propeller speeds.

2. The rudder assembly of claim 1, wherein said input includes a plurality of settings corresponding to respective desired propeller speeds to operatively actuate said propeller at said respective desired propeller speeds.

3. The rudder assembly of claim 2, wherein:

said propeller includes a motor and at least two blades selectively rotated by said motor;

said propeller motor is housed in said rudder;

said propeller blades extend from said rudder;

said battery is located outside said rudder;

wiring extends through said rudder to allow electrical communication between said battery and said propeller motor;

said rudder includes a steering portion extending in a generally vertical direction and a linkage attachment portion extending bilaterally to said steering portion; and said first and second linkages are coupled to said linkage attachment portion.

4. The rudder assembly of claim 3, wherein:

said pedal of said first pedal assembly is movably coupled to said adjustable rail of said first pedal assembly; and said pedal of said second pedal assembly is movably coupled to said adjustable rail of said second pedal assembly.

5. The rudder assembly of claim 1, wherein:

said pedal of said first pedal assembly is movably coupled to said adjustable rail of said first pedal assembly; and said pedal of said second pedal assembly is movably coupled to said adjustable rail of said second pedal assembly.

* * * * *